US007274335B2

(12) United States Patent
Kim et al.

(10) Patent No.: US 7,274,335 B2
(45) Date of Patent: Sep. 25, 2007

(54) ANTENNA FOR SLIDE-TYPE WIRELESS TERMINAL DEVICE

(75) Inventors: Yong-jin Kim, Seoul (KR); Do-hoon Kwon, Seoul (KR); Seong-soo Lee, Suwon-si (KR); Young-eil Kim, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 11/442,529

(22) Filed: May 30, 2006

(65) Prior Publication Data

US 2007/0120750 A1 May 31, 2007

(30) Foreign Application Priority Data

Nov. 30, 2005 (KR) ..... 10-2005-0115343

(51) Int. Cl.
*H01Q 1/24* (2006.01)

(52) U.S. Cl. ..... 343/702; 343/700 MS

(58) Field of Classification Search ..... 343/700 MS, 343/702, 846

See application file for complete search history.

(56) References Cited

U.S. PATENT DOCUMENTS

| | | | | |
|---|---|---|---|---|
| 6,073,027 | A * | 6/2000 | Norman et al. | 455/575.4 |
| 6,980,840 | B2 * | 12/2005 | Kim et al. | 455/575.4 |
| 7,012,571 | B1 * | 3/2006 | Ozkar et al. | 343/702 |
| 2006/0001581 | A1 * | 1/2006 | Lee et al. | 343/702 |
| 2006/0145932 | A1 * | 7/2006 | Lim | 343/702 |

FOREIGN PATENT DOCUMENTS

| | | | |
|---|---|---|---|
| KR | 10-2005-0082150 | A | 8/2005 |
| LR | 2001-0028316 | A | 4/2001 |

* cited by examiner

*Primary Examiner*—Tan Ho
(74) *Attorney, Agent, or Firm*—Sughrue Mion, PLLC

(57) ABSTRACT

An antenna for a slide-type wireless terminal device includes a radiator formed in a first body, a ground surface formed on a second body, a power feeder connected to the ground surface in the second body, a first connection part connected to the radiator in the first body and operative to come in contact with the power feeder when the first body is slidably moved, and a short-circuit wire operative to come in contact with the radiator and the ground surface when the first body is slidably moved.

6 Claims, 4 Drawing Sheets

ANTENNA FOR SLIDE-TYPE WIRELESS TERMINAL DEVICE

This application claims priority under 35 U.S.C. § 119 from Korean Patent Application No. 2005-0115343, filed on Nov. 30, 2005, the entire content of which is incorporated herein by reference.

BACKGROUND OF THE INVENTION

1. Field of the Invention

The invention relates to an antenna for a slide-type wireless terminal device, and more particularly to an antenna for a slide-type wireless terminal device for wireless communication and an additional RFID antenna as an embedded antenna.

2. Description of the Related Art

An antenna is a component for converting an electric signal or an electromagnetic wave signal. For example, a wireless terminal device receives an RF signal through an antenna and transmits an internal signal to a free space through the antenna.

The antenna applied to the wireless terminal device is mainly classified into an inner antenna and an external antenna. The inner antenna comprises a ceramic chip antenna and an inverted-F antenna, while the external antenna comprises a helical antenna and a monopole antenna.

The early wireless mobile terminal generally employed the external antenna, but because of harmfulness to human body due to electromagnetic waves, poor portability due to a large volume, and a high price, interest in the inner antenna is gradually increased. The inner antenna is also referred to as an "antenna".

Recently, as a demand for a slide-type wireless mobile terminal is increased due to convenience of opening/closing the mobile terminal, the need of securing of the mounting space for the inner antenna is on the rise.

One example of the inner antenna that is built in the slide-type mobile terminal is disclosed in PCT Patent Publication WO 98/09414, in which an antenna is formed on the cover and body of a mobile terminal.

In order to maximize the characteristic of a dipole antenna, the antenna must have a length equivalent to a half wavelength, but the mobile terminal generally falls short of the length. Accordingly, by extending the antenna from the body to the cover, the length of the antenna is adjusted to the half wavelength.

In the above patent publication, the antenna is formed on both the cover and the body of the mobile terminal. Therefore, when the cover is slidably moved from the body, the length of the antenna is extended to make the communication possible.

However, a space of a significant size is required in the mobile terminal in order to mount the antenna therein, and thus the size of the mobile terminal is increased according to the overall length of the antenna.

SUMMARY OF THE INVENTION

The present invention has been developed in order to address the above drawbacks and other problems associated with the conventional arrangement. An aspect of the present invention is to minimize the space occupied by an antenna in a slide-type wireless terminal device by separately providing two bodies of the wireless terminal device with a discharge element and a ground surface of the antenna.

The foregoing and other objects and advantages are substantially realized by providing an antenna for a slide-type wireless terminal device including a first body and a second body, which are slidably moved to each other in a vertical direction, according to the present invention, which comprises a radiator formed in the first body, a ground surface formed on the second body, a power feeder connected to the ground surface in the second body, a first connection part connected to the radiator in the first body and operative to come in contact with the power feeder when the first body is slidably moved, and a short-circuit wire operative to come in contact with the radiator and the ground surface when the first body is slidably moved.

The antenna may further comprise a second connection part connected to the power feeder in the second body and operative to come in contact with the first connection part when the first body is slidably moved.

The radiator may be an inverted F antenna or a planar inverted F antenna.

The radiator may be provided in a rear side of a display unit in the first body.

The ground surface may be a circuit board of the second body.

The antenna may further comprise a third connection part interposed between the short-circuit wire and the ground surface.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE EXEMPLARY EMBODIMENTS

Figure 1:
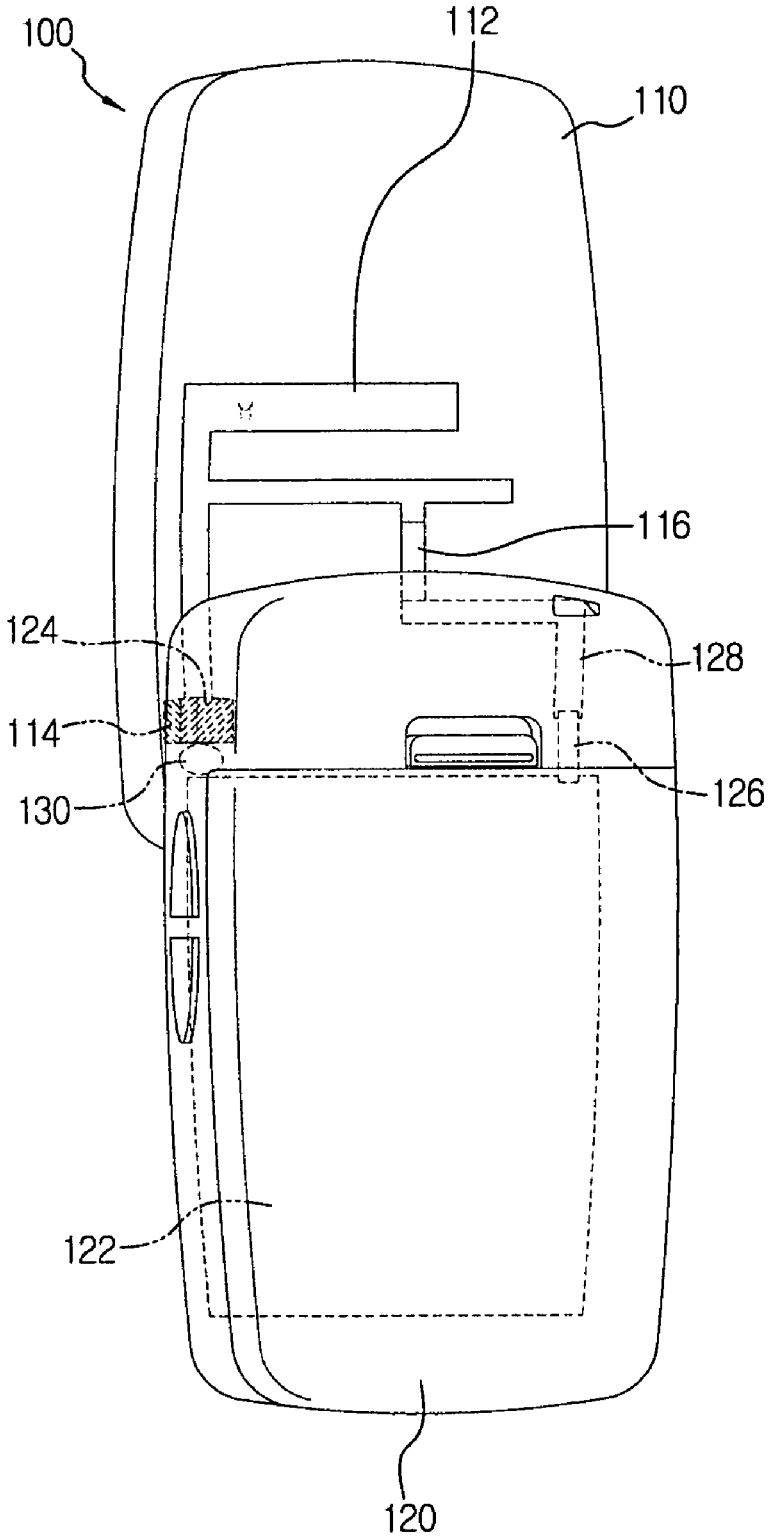
FIG. 1 is a view illustrating an antenna for a slide-type wireless terminal device according to one embodiment of the present invention.

Exemplary embodiments of the present invention will be described in greater detail with reference to the accompanying drawings.

In the following description, same drawing reference numerals are used for the same elements even in different drawings. The matters defined in the description such as a detailed construction and elements are provided only to assist in a comprehensive understanding of the invention. The present invention can be carried out without those defined matters. Also, well-known functions or constructions are not described in detail since they would obscure the invention in unnecessary detail.

FIG. 1 is a view illustrating an antenna for a slide-type wireless terminal device according to one embodiment of the present invention.

A slide-type wireless terminal device 100 includes a first body 110 and a second body 120, in which the bodies 110 and 120 are slidably moved to each other in a vertical direction. The first body 110 is provided with a display unit, and the second body 120 is provided with a key input.

Referring to FIG. 1, the first body 110 comprises a radiator 112, a first connection part 114, and a first short-circuit wire 116, and the second body 120 comprises a ground surface 122, a power feeder 130, a second connection part 124, a second short-circuit wire 128, and a third connection part 126.

The radiator 112 is provided in the first body 110 of the slide-type wireless terminal device 100. The first body 110 may be provided with the display unit, and the radiator 112 may be provided in a marginal space formed at a rear side of the display unit.

The radiator 112 is supplied with an electric current from the power feeder 130 to radiate electromagnetic waves. The radiator 112 may be an inverted F antenna or a planar inverted F antenna.

A space of an approximate dimension of 35*15*5 mm will be enough to house the radiator 112 in the first body 110. Since the marginal space of the rear side of the display unit is used, it is possible to miniaturize the slide-type wireless terminal device 100.

The first connection part 114 is connected to the radiator 112 in the first body 110, and is operative to contact the power feeder 130 of the second body 120 when the first body 110 is slidably moved. In this case, the electric current is supplied to the radiator 112 from the power feeder 130 through the first connection part 114. To this end, the first connection part 114 may be made of a metal having good conductivity.

The first short-circuit wire 116 is a part of a short-circuit wire for connecting the radiator 112 of the first body 110 with the ground surface 122 of the second body 120, and is operative to be connected with the second short-circuit wire 128 when the first body 110 is slidably moved.

The ground surface 122 is formed on the second body 120. In this embodiment, since the intact ground surface 122 is applied to the circuit board of the second body 120, the internal space of the slide-type wireless terminal device 100 can be efficiently utilized.

The power feeder 130 supplies the electric current to the radiator 112, and specifically supplies the electric current supplied from the signal input terminal (not shown) of the circuit board to the radiator 112. In this embodiment, the power feeder 130 is formed on the second body 120, but the present invention is not limited thereto.

Specifically, the power feeder 130 may be formed on the first body 110 or the second body 120, if necessary. If the power feeder 130 is formed on the first body 110, the circuit board and the power feeder 130 must be connected to each other through desired connection means so that the electric current is supplied to the radiator 112 from the circuit board.

The second connection part 124 is connected to the power feeder 130 at the second body 120, and is operative to be connected to the first connection part 114 when the first body 110 is slidably moved. Since the second connection part 124 serves as a supply path of the electric current for connecting the circuit board and the power feeder 130, it may be made of a metal having good conductivity.

In this embodiment, the circuit board is connected to the power feeder 130 through the second connection part 124, but the circuit board may be directly connected to the power feeder 130, if necessary, without using the second connection part 124.

The second short-circuit wire 128 is a part of the short-circuit wire for connecting the radiator 112 of the first body 110 and the ground surface 122 of the second body 120, and is operative to be connected with the first short-circuit wire 116 when the first body 110 is slidably moved. The third connection part 126 may be formed on the contacting portion between the second short-circuit wire 128 and the circuit board.

As described above, the electric current supplied from the signal input terminal of the circuit board is supplied to the radiator 112 through the second connection part 124 of the second body 120, the power feeder 130, and the first connection part 114 of the first body 110.

Figure 2:
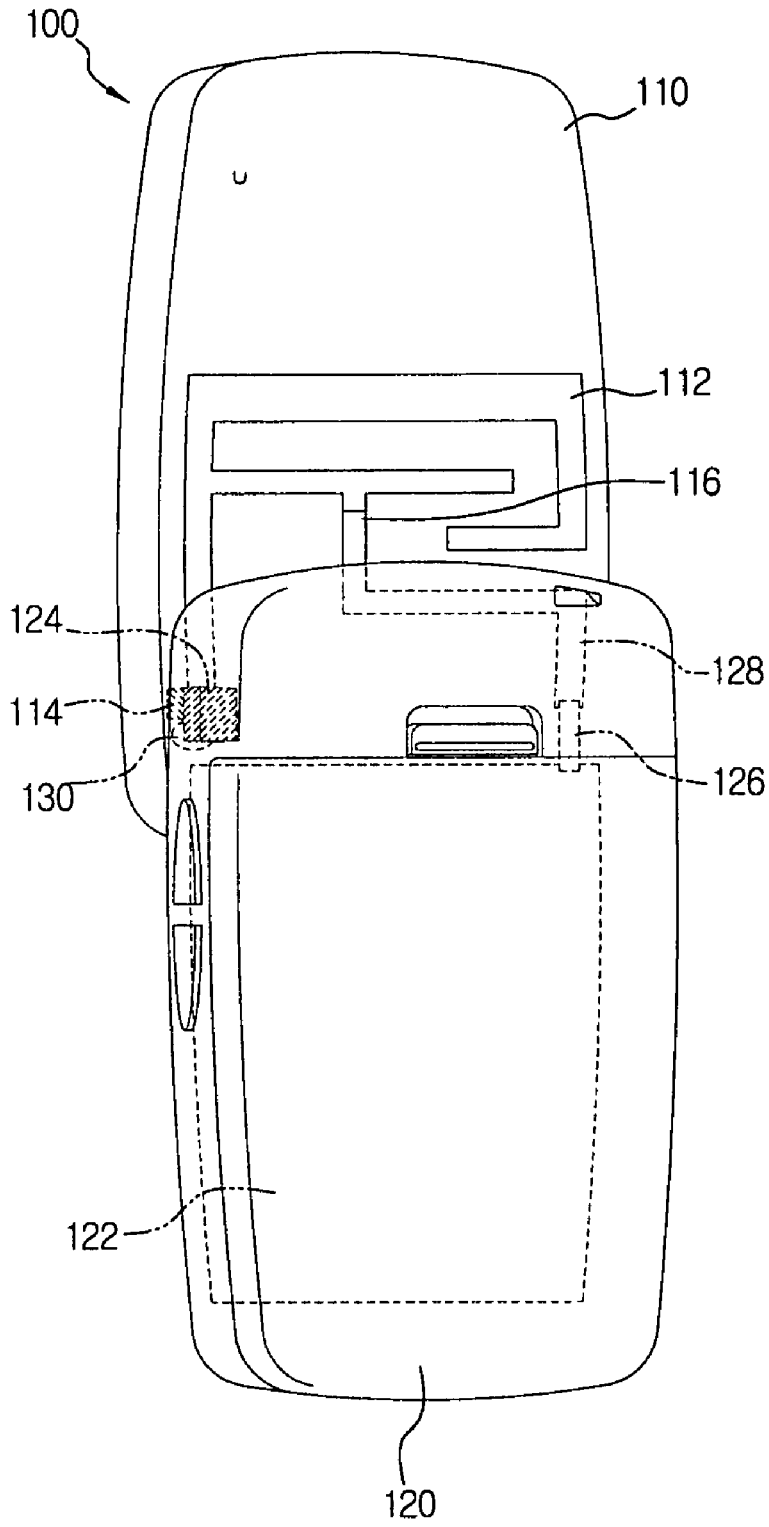
FIG. 2 is a view illustrating an antenna for a slide-type wireless terminal device according to another embodiment of the present invention.

FIG. 2 is a view illustrating an antenna for a slide-type wireless terminal device according to another embodiment of the present invention.

While FIG. 1 shows that the power feeder 130 and the circuit board are formed on the second body 120, FIG. 2 shows that the power feeder 130 is formed on the first body 110. The antenna shown in FIG. 2 is similar to that shown in FIG. 1. The same components as those of FIG. 1 are denoted by the same reference numeral, and different components will be described herein.

The first body 110 provided with the display unit comprises the radiator 112, the first connection part 114, the power feeder 130, and the first short-circuit wire 116, and the second body 120 provided with a key input comprises the ground surface 122, the second connection part 124, the third connection part 126, and the second short-circuit wire 128.

The power feeder 130 is provided on one side of the radiator 116 in the first body 110, and the first connection part 114 is provided between the power feeder 130 and the radiator 112 in an electrically conductible portion.

The intact ground surface 122 is applied to the circuit board of the second body 120, and the second connection part 124 is provided at the position contacting the power feeder 130 of the first body 110 when the first body 110 is slidably moved.

In this embodiment, the electric current supplied from the signal input terminal of the circuit board is supplied to the radiator 112 through the second connection part 124 of the second body 120, the power feeder 130, and the first connection part 114 of the first body 110.

As described above, since the power feeder 130 is supplied with the electric current from the circuit board, the power feeder 130 may be provided to the second body 120. In some cases, the power feeder 130 may be provided to the first body 110 with no circuit board.

As shown in the drawings, the slide-type wireless terminal device 100 having the antenna according to the present invention may be a common mobile terminal having a length of 84 mm and a width of 38 mm. Further, the circuit board applied to the slide-type wireless terminal device 100 may be a board made of FR4-epoxy having a thickness of 1 mm.

Figure 3:
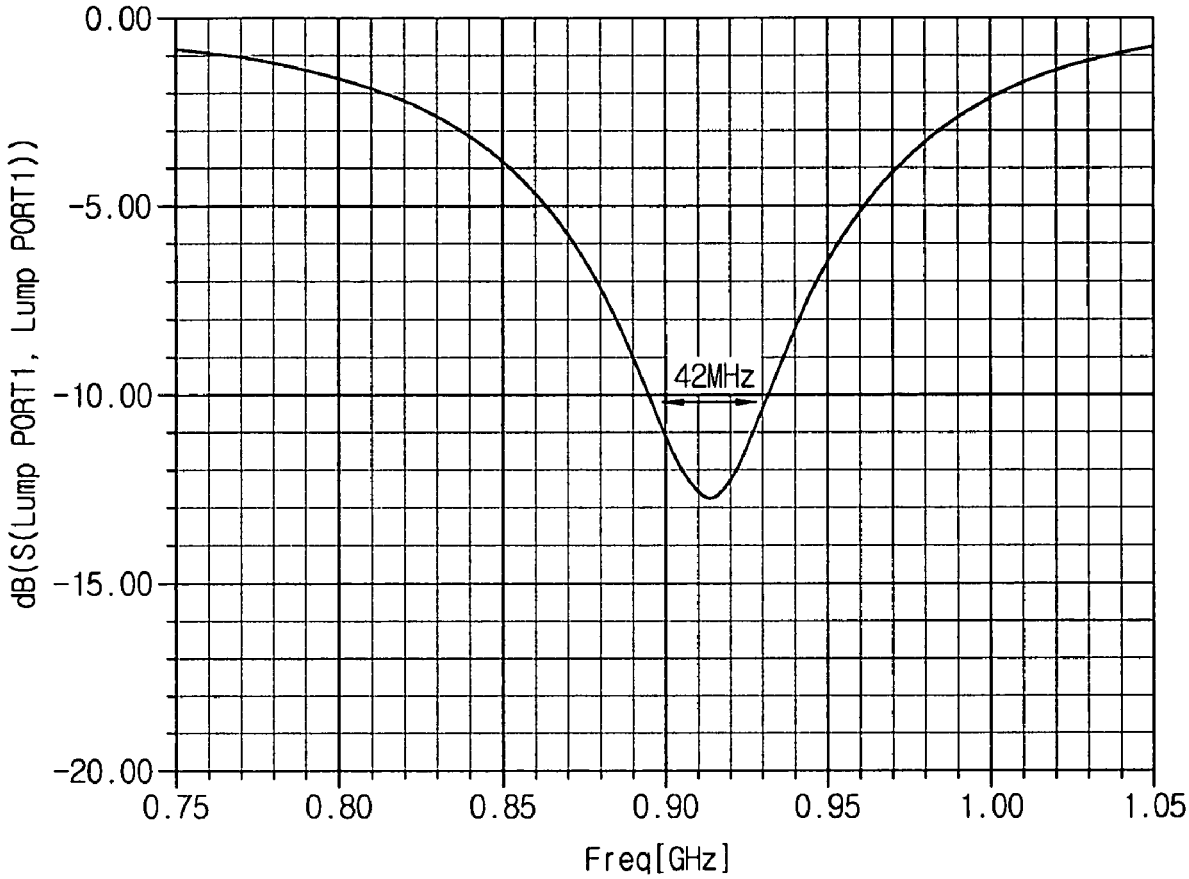
FIG. 3 is a graph showing measured return loss with respect to an operating frequency of an antenna for a slide-type wireless terminal device according to the present invention.

FIG. 3 is a graph showing measured return loss with respect to an operating frequency of the antenna for the slide-type wireless terminal device according to the present invention.

In the prior art, the inverted F antenna or planar inverted F antenna applied as the radiator 112 is mounted to the second body 120 having the key input in the slide-type wireless terminal device 100, which is mainly utilized as a communication antenna.

In the present invention, however, although the IFA/PIFA type of the radiator 112 is placed in the first body 110 having the display unit in the slide-type wireless terminal device 100, it can secure about 80 MHz bandwidth at 900 MHz band (VSWR 3 standard). Referring to the graph, it is possible to secure 83 MHz (870 MHz to 953 MHz) bandwidth at 913 MHz band.

Also, in case the antenna is applied to radio frequency identification (RFID), the antenna should have a bandwidth of more than 40 MHz. Referring to the graph, it is possible to secure 42 MHz (934 MHz to 892 MHz) bandwidth at 913 MHz band, and thus the antenna according to the present invention can be applied to the RFID.

Figure 4:
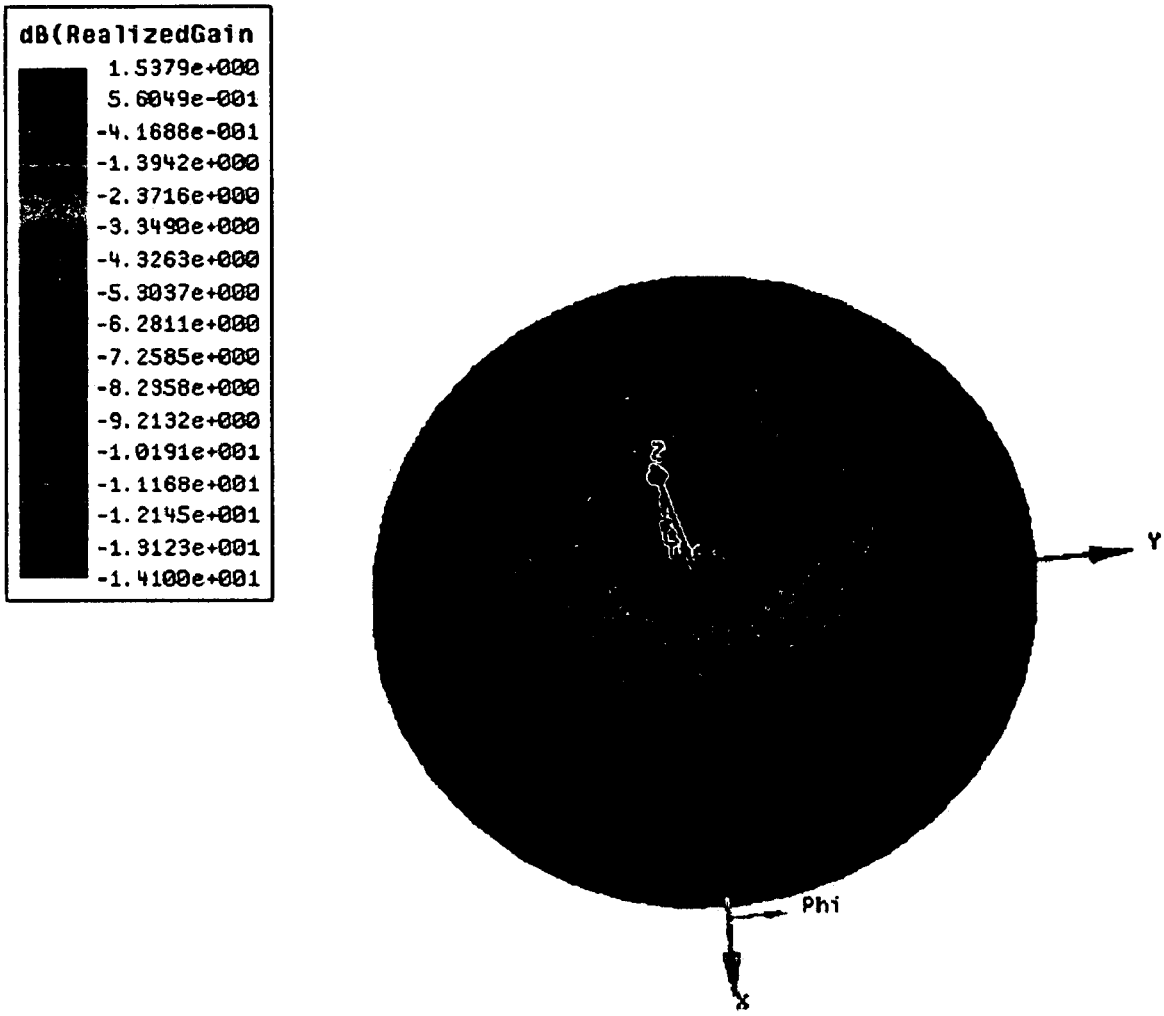
FIG. 4 is a view showing a radiation pattern of an antenna for a slide-type wireless terminal device.

FIG. 4 is a view showing a radiation pattern of the antenna for the slide-type wireless terminal device 100.

The radiation pattern of the antenna for the slide-type wireless terminal device 100 shown in FIG. 4 shows a 3-dimensional radiation pattern, and more particularly shows a doughnut-shaped radiation pattern similar to that of a conventional dipole antenna.

In the radiation pattern, a portion furthest from the center corresponds to a maximally radiated portion, and a portion nearest to the center corresponds to a hardly radiated portion. As shown in FIG. 4, the maximum radiation gain of the antenna according to the present invention is about 1.54 dBi. It will be understood from the results that the antenna of the present invention has a performance equal to or more than the radiation gain provided by the conventional inner antenna.

Therefore, contrary to the conventional inner antenna for the wireless terminal device which is formed in the second body 120, the antenna for the slide-type wireless terminal device 100 according to the present invention is provided in the first body 110 as the radiator 112, so that both the conventional inner antenna and the antenna according to the present invention may be provided to the slide-type wireless terminal device 100.

As described above, in the antenna for the slide-type wireless terminal device according to the present invention, since the radiators and the ground surfaces each provided to the first and second bodies come into contact with each other depending upon the sliding movement of the slide-type wireless terminal device, so that the radiating position of the antenna may be positioned at the front end of the slide-type wireless terminal device, without using additional cable.

Also, in addition to the inner antenna previously embedded in the slide-type wireless terminal device, the RFID antenna may be embodied in the type of an inner antenna having similar performance.

Further, since the radiator is provided in the first body and the circuit board of the second body serves as the ground surface, a large space for the antenna mounting is not necessary, and thus the space of the wireless terminal device may be effectively utilized.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. An antenna for a slide-type wireless terminal device including a first body and a second body, which are slidably moved to each other in a vertical direction, the antenna comprising:

a radiator formed in the first body;

a ground surface formed on the second body;

a power feeder connected to the ground surface in the second body;

a first connection part connected to the radiator in the first body and operative to come in contact with the power feeder when the first body is slidably moved; and a short-circuit wire operative to come in contact with the radiator and the ground surface when the first body is slidably moved.

2. The antenna as claimed in claim 1, further comprising a second connection part connected to the power feeder in the second body and operative to come in contact with the first connection part when the first body is slidably moved.

3. The antenna as claimed in claim 1, wherein the radiator is an inverted F antenna or a planar inverted F antenna.

4. The antenna as claimed in claim 1, wherein the radiator is provided in a rear side of a display unit in the first body.

5. The antenna as claimed in claim 1, wherein the ground surface is a circuit board of the second body.

6. The antenna as claimed in claim 1, further comprising a third connection part interposed between the short-circuit wire and the ground surface.

* * * * *